US008132513B2

(12) United States Patent
Crawford et al.

(10) Patent No.: US 8,132,513 B2
(45) Date of Patent: Mar. 13, 2012

(54) AMUSEMENT PARK RIDE WITH A VEHICLE DRIVE THAT DECOUPLES UPON LOSS OF POWER

(75) Inventors: David W. Crawford, Long Beach, CA (US); Edward A. Nemeth, Hermosa Beach, CA (US); Derek Lee Howard, Pasadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 174 days.

(21) Appl. No.: 12/557,681

(22) Filed: Sep. 11, 2009

(65) Prior Publication Data

US 2011/0061558 A1 Mar. 17, 2011

(51) Int. Cl.
*A63G 1/00* (2006.01)

(52) U.S. Cl. ..... 104/53; 104/63

(58) Field of Classification Search ..... 104/53, 104/56, 59, 63, 64, 69, 70, 72, 73, 290, 292; 472/131, 133, 50
See application file for complete search history.

(56) References Cited

U.S. PATENT DOCUMENTS

| | | | | |
|---|---|---|---|---|
| 3,884,154 | A | 5/1975 | Marten | |
| 4,061,089 | A | 12/1977 | Sawyer | |
| 4,731,569 | A | 3/1988 | Bohn | |
| 4,991,514 | A * | 2/1991 | Powell et al. | 104/60 |
| 4,993,327 | A * | 2/1991 | Labarre et al. | 104/290 |
| 5,473,990 | A * | 12/1995 | Anderson et al. | 104/85 |
| 5,595,121 | A * | 1/1997 | Elliott et al. | 104/53 |
| 6,062,350 | A | 5/2000 | Spieldiener et al. | |
| 6,170,402 | B1 * | 1/2001 | Rude et al. | 104/53 |
| 6,450,103 | B2 | 9/2002 | Svensson | |
| 6,971,317 | B2 * | 12/2005 | McKoy | 104/72 |
| 6,983,701 | B2 | 1/2006 | Thornton et al. | |
| 7,314,008 | B2 | 1/2008 | Li | |
| 7,380,508 | B2 * | 6/2008 | Li | 104/284 |
| 7,432,791 | B2 | 10/2008 | Hahn et al. | |
| 7,562,628 | B2 * | 7/2009 | Wamble et al. | 104/281 |
| 2005/0011399 | A1 | 1/2005 | Skoblenick et al. | |
| 2007/0017411 | A1 * | 1/2007 | Pulliam | 104/124 |
| 2008/0051205 | A1 * | 2/2008 | Roodenburg et al. | 472/43 |

(Continued)

FOREIGN PATENT DOCUMENTS

WO 0029086 5/2000

*Primary Examiner* — S. Joseph Morano
*Assistant Examiner* — Jason C Smith
(74) *Attorney, Agent, or Firm* — Marsh Fischmann & Breyfogle LLP; Kent Lembke

(57) ABSTRACT

An amusement park ride with one or more evacuation zones. The ride includes a track with a rail defining a ride path. The ride path includes at least one evacuation zone along a first length of the track at a first height and a non-evacuation zone along a second length of the track with one or more portions at a second height greater than the first height. The track is sloped in the non-evacuation zone toward the evacuation zone. The ride includes a vehicle supported on the rail via roller elements such as load bearing wheels. The ride includes a drive assembly that provides a driving force to selectively move the vehicle along the ride path. The drive assembly is adapted to automatically disengage from the vehicle upon loss of power. The vehicle is free rolling upon loss of power to travel to the evacuation zone based on gravity.

23 Claims, 4 Drawing Sheets

U.S. PATENT DOCUMENTS

2008/0148990 A1* 6/2008 Wamble et al. ..... 104/281
2009/0031913 A1* 2/2009 Heaslip et al. ..... 104/63
2009/0114114 A1* 5/2009 Rose et al. ..... 104/53
2009/0158955 A1* 6/2009 Pulliam ..... 104/168
2009/0266267 A1* 10/2009 Moss ..... 104/53
2009/0269175 A1* 10/2009 Rose et al. ..... 414/373
2011/0061558 A1* 3/2011 Crawford et al. ..... 104/53
2011/0088584 A1* 4/2011 Baker et al. ..... 104/74

* cited by examiner

AMUSEMENT PARK RIDE WITH A VEHICLE DRIVE THAT DECOUPLES UPON LOSS OF POWER

BACKGROUND OF THE INVENTION

1. Field of the Invention

The present invention relates, in general, to amusement park rides such as dark rides that provide evacuation points upon loss of power, and, more particularly, to systems and methods for driving or propelling vehicles along a track in a dark or other amusement park ride so as to allow fewer evacuation points for vehicles on loss of power, e.g., by providing a drive or propulsion system that decouples from the vehicle upon loss of power allowing the vehicles to continue to travel to an evacuation point provided along the track.

2. Relevant Background

Amusement parks continue to be popular worldwide with hundreds of millions of people visiting the parks each year. Many rides incorporate a slower portion or segment to their rides to allow them to provide a "show" in which animation, movies, three-dimensional (3D) effects, audio, and other effects are presented as vehicles proceed through such show portions. For example, a roller coaster may be designed such that in a show portion dinosaurs attack vehicles, meteors fly toward the passengers, animatronic figures perform, and the like. The show may be designed based on the anticipated speed of the vehicle after it enters the show portion such that an effect such as 3D "attack" on the vehicle occurs precisely when the vehicle is adjacent to a portion of the display screens, speakers, and/or other show equipment. Other rides are designed such that the show includes jets, streams, and other water effects that require knowledge of vehicle position and speed to achieve desired effects such as water passing near passengers without striking the passengers or vehicle. Other rides are used to tell stories, and it is desirable to control the speed or pace of the vehicles during show sections of the ride so the passengers can enjoy the set, which may include special effects that are sensitive to or synchronized to vehicle speed (e.g., a multimedia presentation may actually be intentionally distorted such that it appears normal to passengers in a vehicle when the vehicle is moving at a particular speed but when the vehicle is moving too fast or too slow the distortion may be seen).

Ride designers or engineers are given the task of producing unique attractions that provide show portions while also providing rides that are less costly to operate and maintain. Typically, amusement park rides are designed to provide drive systems for moving vehicles in a manner that tightly controls the speed of the vehicles along the track and, particularly, in show portions. In a conventional ride, a mechanical coupling is provided between the vehicle and the drive or propulsion mechanism such as in a dark ride used mainly to provide a show with themed display. Upon loss of power, the vehicle is locked or frozen to or on the track. In designing an amusement park ride, it is preferred that the track and adjacent platforms provide adequate evacuation points for passengers even when power is lost for the drive or propulsion. As a result, new designs for rides often will include evacuation points at every point along the track, which can significantly limit the track or ride design or can drive up attraction costs.

In one particular case, there have been a number of concepts generated for new suspended and self-powered ride systems that would be useful in dark ride attractions. Many of these have failed to receive capital funding for a number of reasons including costs associated with meeting existing evacuation requirements within the amusement park ride industry. It has proven difficult to meet the demand for a powered vehicle that can have its speed controlled throughout a ride rather than simply being periodically paced as is the case with roller coasters while also providing full evacuation capability upon power loss, e.g., not acceptable to have a vehicle be coupled to a section of track where there is no evacuation platform or ready access. There are also demands for rides to provide gravity drops, cause variable speeds, include steeper inclines and declines than typically provided on dark rides, and other operating parameters to increase guest satisfaction, but these design features also contribute to increased costs and are difficult to address with existing ride drive or propulsion systems.

SUMMARY OF THE INVENTION

The present invention addresses the above problems by providing amusement park rides that provide for evacuation of passengers upon loss of power or similar faults that prevent use of a drive. One embodiment of such rides provides a track or rail system for guiding a number of passenger or ride vehicles, and the track includes evacuation zones (with loading/unloading platforms) at heights or elevations that are lower than adjacent non-evacuation zones or segments. The non-evacuation zones or segments are inclined or sloped to cause vehicles to tend to travel under the influence of gravity toward a previous or next evacuation zone along the direction (or opposite the normal direction) of travel of the ride.

The vehicles are supported on the track by one or more roller elements or wheels (e.g., freely pivoting or rotating wheels or rollers that abut the track). A drive assembly is provided that provides a driving or propulsion force to the vehicle to move it along the track such as at a controlled speed in some portions of the track (e.g., a show portion of the track or ride). The drive assembly also is adapted for automatically disengaging or decoupling upon loss of power or fault such that the vehicle is able to roll to an evacuation zone or segment on the load wheels or rollers. For example, the drive assembly may include a series of linear synchronous motors (LSMs) or linear induction motors (LIMs) that are mounted on or near the track to apply a magnetic thrust on a magnet array provided on the vehicle body, with the LSMs/LIMs used for propulsion but not for levitation of the vehicle that is track guided.

When operated or powered, the drive assembly may be adapted to provide continuous control of each ride vehicle's speed and position throughout a ride experience independent of the track geometry (i.e., not controlled strictly by gravity). The ride system may be a suspended ride with the vehicles suspended under the track's rail(s) with the support load placed on one or more load wheels pivotally attached to the vehicle body. The drive assembly is preferably adapted for automatically disengaging from driving the vehicle body (e.g., from capture driven to free rolling) to allow the vehicle body to roll on the load wheels to a lower elevation evacuation zone or segment of the track. In some ride embodiments, the drive assembly may also be selectively controlled to disengage so as to provide free falling ride experiences such as when a peak is crested to allow the vehicle to coast unimpeded down a steep slope in the track such that the vehicle may be free rolling on demand as well as on loss of power.

More particularly, an amusement park ride is provided that includes a track with one or more rails defining a ride path. The ride path may include at least one evacuation zone along a first length of the track and at a first height and a non-evacuation zone along a second length of the track with one or more portions that are at a second height that is greater than the first height. The track may be sloped in the non-evacuation zone toward the evacuation zone. The ride includes a vehicle supported on the rail(s) via one or more roller elements (such as load bearing wheels). The ride also includes a drive assembly that provides a driving or propulsion force to selectively move the vehicle along the ride path. The drive assembly is adapted or configured to automatically disengage from the vehicle upon loss of power (e.g., have a drive coupling disengage, have drive components such as an LSM or LIM device and drive reactive components (such as a ferrous metal plate/block such an array of magnets or conductors) remain spaced apart) such that the vehicle is free rolling upon loss of power to travel to the evacuation zone based on gravity.

The drive assembly may include an electromagnetic drive member or thruster such as a series of LSMs or LIMs that are provided proximate to the track to provide the driving force, and the drive assembly may also include a drive reactive component (such as a conductor, a magnet, or other ferrous metal member) or array of such components that are positioned on the vehicle so as to be spaced apart a distance or gap from the electromagnetic drive member (when the vehicle is supported on the track by the roller elements or wheels). In some embodiments, the vehicle is suspended on the roller elements below the one or more rails of the track, and in such cases the electromagnetic drive member may be mounted to the rail with the drive reactive component or array of such components provided in a portion of the vehicle vertically below the drive member (e.g., the vehicle is not a magnetically levitated vehicle).

The non-evacuation zone of the track may include a free fall or steeply inclined zone, and the drive assembly may include a disengaging mechanism that acts without power (or on the loss of power such as with a spring force) to space apart a first portion of the drive assembly provided on the vehicle from a second portion of the drive assembly provided on the track (e.g., two portions that are in contact when the drive assembly provides the driving force such as by use of a powered actuator but then become spaced apart upon power loss).

DETAILED DESCRIPTION OF THE PREFERRED EMBODIMENTS

Figure 1:
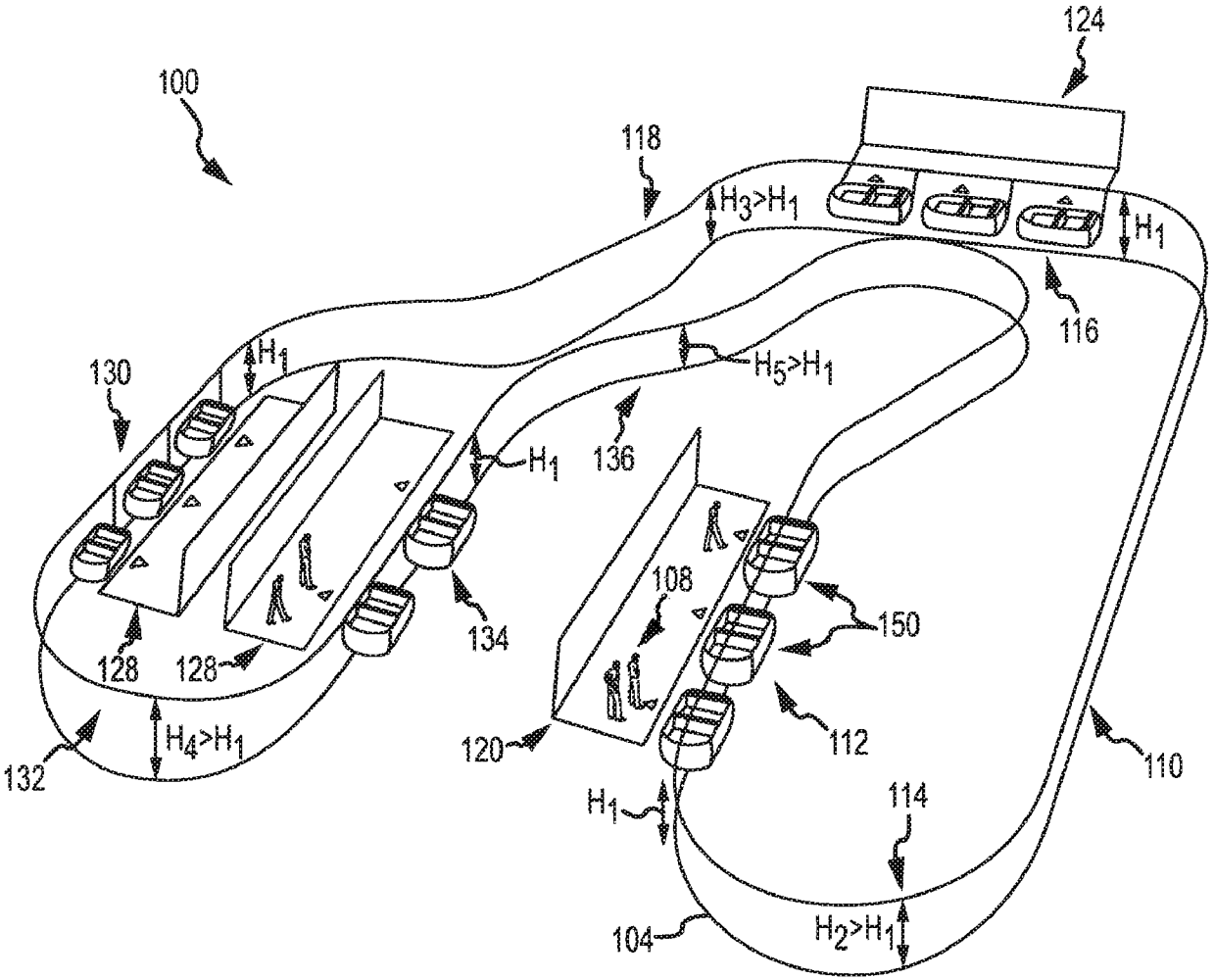
FIG. 1 is a perspective view of an amusement park ride such as a suspended-vehicle, dark ride that provides a track design useful with an automatically and/or selectively decoupling drive or propulsion assembly described herein to control velocity of vehicles along a track and also allow travel of the vehicles under gravity to evacuation points or portions of the track.

Briefly, embodiments described herein are directed to amusement park rides that provide a number of evacuation zones by using a combination of a track geometry with alternating low elevation segments (evacuation zones) and higher elevation, sloped segments (non-evacuation zones). This track geometry is combined with a free-rolling vehicle design (e.g., vehicle bodies supported on relatively free rotating wheels or rollers) and a drive assembly that decouples selectively (such as in free-fall zones) and upon loss of power such that vehicles roll under the force of gravity to the evacuation zones. One differentiation with existing coaster launch systems may be a more ongoing or even continuous control of vehicle speed and/or vehicle position with the drive assembly in relation to time and/or track position throughout the entire or a large portion of the ride experience (or path defined by the track).

Generally, embodiments may include a non-mechanically coupled drive or propulsion system, with some implementations using an electromagnetic propulsion system such as a linear synchronous motors (LSM) or linear induction motor (LIM) propulsion system to provide a non-contact propulsion extending along the entire or drive portions of the track (e.g., the LSM/LIM stator module may be track mounted with a drive reactive component such as a magnet(s) or a conductor (s) provided on the vehicle body adjacent the track). The vehicles are not magnetically levitated, though, as each vehicle is supported or suspended on the ride track by roller elements or wheels that contact the track and allow the vehicle to free roll on the track when not captured/driven by the drive assembly.

In some cases, a non-mechanically coupled drive system includes a track-mounted portion along the entire or portions of the track to provide a propulsion or driving force to individual vehicles of the ride system (which may be spaced at regular or varying intervals). The driving force may be used to control the speed of the vehicles such as in themed show portions and to provide a driving force to move the vehicles up inclined portions (and/or in a controlled manner down slopes). In some cases, the driving force is removed or the drive assembly is disengaged or decoupled from the vehicle on downslopes of the track to provide a fast free falling experience. In this manner, a true gravity drop is achieved by simply eliminating or turning off the propulsion equipment along declined track segments and then re-engaging with the drive assembly (e.g., a linear motor system) after the drop is completed or partially completed under the force of gravity. The non-mechanical coupling may be used to provide a more smooth transition (with less parts and wear to the drive mechanism) after the gravity drop.

In preferred embodiments, the drive system is designed to be decoupled or disengaged from the vehicle upon a loss of power or a fault condition. Specifically, the absence of a mechanical connection between the track and the vehicle via the drive system allows for predictable vehicle motion under such fault conditions. This enables much simpler evacuation strategies to be provided in the amusement park rides similar to those used on roller coaster-type rides as opposed to systems with drive systems mechanically coupled to the track that cause vehicles to stop on the track when power is lost, which requires evacuation provisions along the entire length of the track. In contrast, the amusement park rides described herein typically include a vehicle that freely rolls upon a track (e.g., a suspended vehicle supported via free-rolling wheels abutting a track) upon a loss of power (e.g., with the drive system disengaged), and the track has evacuation points or portions with lower elevations than adjacent track portions that are inclined to gravity feed the vehicles to the evacuation points when not actively driven or captured by the drive system (e.g., no flat portions except at evacuation points and large enough inclines or slopes to cause vehicles to travel down to a nearby evacuation point along the track).

One aspect of amusement park rides taught in this description is that the rides provide for evacuation of passengers from ride vehicles upon loss of power at a set or number of evacuation points or track segments rather than at every point along the track length. FIG. 1 illustrates an amusement park ride according to one embodiment that is configured for providing evacuation in a suspended ride arrangement (as may be used in a dark ride or theme ride with show components). The ride 100 includes a track assembly 110 with a number of evacuation portions or segments 112, 116, 130, 134 intermixed with non-evacuation portions or segments 114, 118, 132, 136 (e.g., segments or portions of the track 110 in which evacuation is not planned or provided for in ride 100). Adjacent or near each evacuation portion or segment 112, 116, 130, 134 are evacuation or load/unload platforms 120, 124, 126, 128 that may be used by passengers 108 to unload upon evacuation or an end of a ride and to load into vehicles at a start of a ride or operation of ride 100.

The ride 100 includes a plurality or set of vehicles 150 for carrying passengers 108 along the length of the track 110 during operation of the ride. In the exemplary ride 100, the vehicles 150 are suspended vehicles that ride below the track 110 between the track 110 and a ride foundation 104 (a platform, a structural foundation, the ground, or the like). Wheels, roller elements, or the like are used to attach the vehicles 150 to the track 110 and allow the vehicles 150 to roll along the track 150 when a drive or propulsion force is applied by a drive assembly and to also free roll under the influence of gravity in inclined or sloped portions of the track 110. As explained in detail below, each of the vehicles 150 may be self-powered (or individually driven) by a vehicle control/propulsion system of ride 100, and, significantly, the drive of each vehicle 150 is designed to provide a propulsion or drive force without requiring mechanical or physical coupling between the vehicles 150 and a drive near the track 110. Instead, upon loss of power, the drive assembly or system of ride 100 is automatically decoupled or disengaged from the vehicles 150.

Since the vehicles 150 are not mechanically coupled to the track 150, they can come to controlled stops in dedicated evacuation portions or zones 112, 116, 130, 134 of track 150 similar to such zones provided in coasters and flume rides. Specific evacuation provisions can be provided at these known locations including loading/unloading platforms 120, 124, 126, 128 for passengers 108. In some embodiments of ride 100, the drive assembly is an LSM or LIM-based system, and the drive assembly may fault into a braking mode such that multiple vehicles 150 may occupy a single evacuation zone or segment such as shown with vehicles 150 in zone/segment 112 in FIG. 1. Low speed/energy impacts may occur between the vehicles 150 but appropriate bumpers or shock absorbing mechanisms may be provided on each vehicle 150 (e.g., bumpers as provided in flume rides or the like).

As shown, the evacuation segments or zones 112, 116, 130, 134 may include lengths of track at a first height (or range of heights), $H_1$, that is smaller in magnitude than the non-evacuation segments or zones along the length of the track 110. For example, non-evacuation segment 114 may have second height (or second range of heights), $H_2$, that is greater than the first height, $H_1$, in zone 112. In operation of ride 100, a vehicle 150 traveling from zone 112 up to zone 114 under a driving force provided by a drive assembly may roll back downward to the zone 112 upon a loss of power as the supporting wheels or roller elements are not driven by the drive assembly and the drive assembly is not mechanically coupled to the vehicle (or does not couple the vehicle 150 to the track in segment 114).

In other cases, the momentum of the vehicle 150 may cause it to continue to roll along its direction of travel on track segment 114 toward the next evacuation zone 116, which also has a smaller height or lower elevation, $H_1$, relative to non-evacuation zone 114. For example, non-evacuation zone 114 may include a peak with a vehicle 150 rolling backwards to evacuation zone 112 upon loss of power before cresting the peak and rolling forwards to evacuation zone 116 (free falling or rolling in either case) after cresting the peak in zone 114. Similarly, upon a loss of power and disengagement of a vehicle drive assembly, a vehicle 150 in non-evacuation zone 118 that has a height or range of heights, $H_3$, that is greater than the first height, $H_1$, will either roll backwards toward evacuation zone 116 or forward to zone 130, which is at a lower height, $H_1$. Likewise, similar free rolling to evacuation zones 130, 134 will occur for a vehicle 150 upon loss of power in zone 132, which is at a higher elevation or range of elevations, $H_4$, and will occur for a vehicle 150 in zone 136, which is at a higher elevation or range of elevations, $H_5$, relative to the evacuation zones 112, 134, which are at a first height, $H_1$. In other embodiments, the evacuation zones 112, 116, 130, 134 do not have equal heights, $H_1$, relative to each other but are simply at a lower height relative to adjacent portions of non-evacuation segments or zones to cause vehicles 150 to free roll to an evacuation zone or segment regardless of where the vehicle 150 may be on track 110 when power is lost and evacuation is needed for passengers 108. The specific inclines or slopes used may be varied to practice the invention and may depend upon industry codes, vehicle and track design, vehicle weight, wheel/rolling element configuration, surfaces, materials, and the like, and other ride characteristics.

Figure 3:
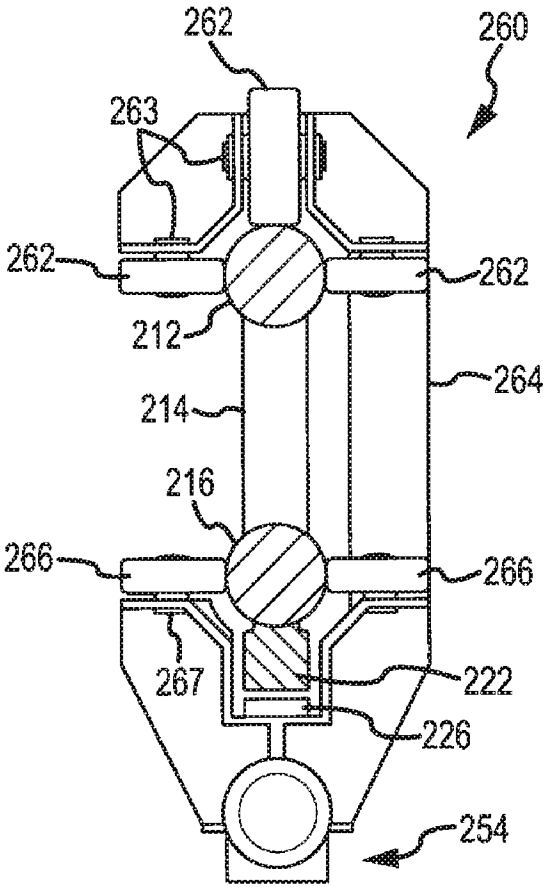
FIG. 3 is a partial sectional view of the ride of FIG. 3 taken at line 3-3 showing detail components of the magnetic drive assembly and the free-rolling vehicle support.
Figure 2:
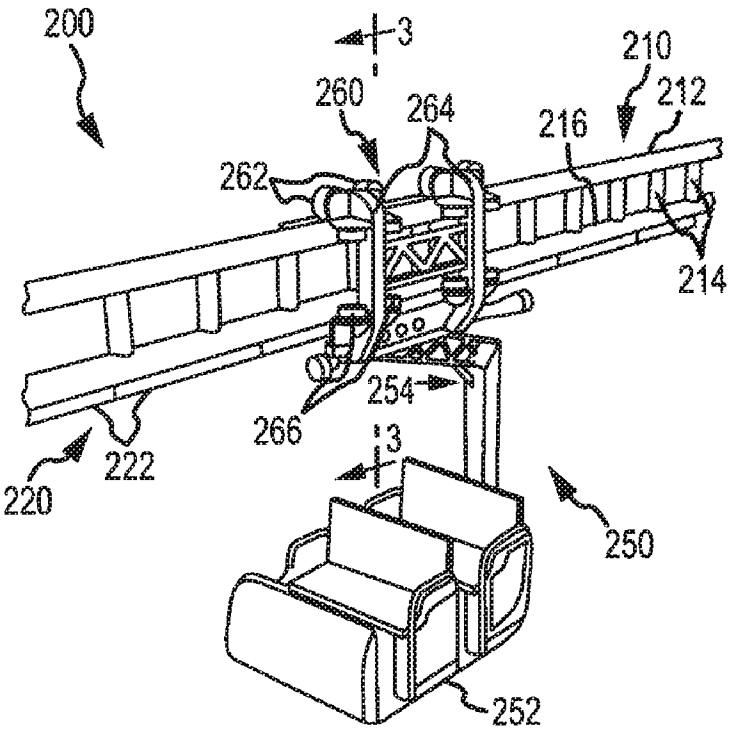
FIG. 2 is a partial perspective view of an amusement park ride with a drive assembly (e.g., a not contact or other arrangement that decouples from the vehicle upon loss of power or in response to control signals) of an embodiment of the invention using a magnetic propulsion to move individual vehicles.

FIG. 2 illustrates a portion of an amusement park ride 200 such as may be used to implement a ride 100 shown in FIG. 1. FIG. 3 illustrates in more detail portions of the vehicle and drive assembly for implementing the ride 200. The ride 200 is a suspended vehicle ride that includes a track assembly 210 providing an upper and lower tubular rail 212, 214 interconnected with vertical frame members 214. The track assembly 210 would be supported above a ride platform as shown in FIG. 1 with evacuation zones or segments of the track 210 having a lower height or elevation (as measured with reference to the ride platform) than non-evacuation zones or segments of the track assembly 210 such that the vehicle 250 is able to free roll under the influence of gravity to an evacuation zone. The track 210 may be thought of as a dual vertical rail arrangement, and the ride 200 may readily be implemented with other suspended track types such as a track found in a typical suspended coaster (e.g., with three or more tubular rails used to support the vehicle 250), a single rail (e.g., a single tube, an I-beam-type rail with vehicle wheels riding on the lower flange on either side of central web, or the like), or other rail arrangement. The particular rail design chosen is not considered limiting to the present invention as long as varying elevations or heights are provided to facilitate evacuation zones upon loss of power or other fault that causes loss of driving forces or propulsion of the vehicles.

The ride 200 further includes a drive assembly 220 that automatically decouples or disengages upon loss of power or fault. In the illustrated embodiment, the drive assembly 220 is also contactless or non-contact making use of electromagnetic forces for propulsion. To this end, a series of magnetic propulsion devices 222 are provided along the length of the track 210. In some embodiments, the propulsion devices 222 are provided along the entire length of the track 210 or at least in portions where velocity control is desired and/or driving force is used such as up inclines or along flat evacuation segments (e.g., a free fall zone or segment may not require the devices 222 as gravity may be used to provide a desired vehicle velocity and ride experience with re-engagement at the end of the steeper sloped segment or zone).

In some embodiments, the devices 222 may be LSM or LIM stators or propulsion and control mechanisms that are attached as shown in FIGS. 2 and 3 to the lower rail 216. To allow magnet thrust forces to be applied by the devices 222 on the vehicle 250, the drive assembly 220 includes a drive reactive component(s) 226 affixed to the vehicle 250, and the component(s) may be any formed using any of a number of ferrous metals and may include one or more magnets such as in the case of LSM devices 222 or conductors (such as one formed of aluminum, copper, or the like) in the case of LIM devices 222.

The magnet(s) or other drive reactive components 226 are spaced apart from the magnetic propulsion devices 222 with the device 222 positioned above the drive reactive component 226 in the ride 200, such that upon loss of power to the devices 222 of drive assembly 220 the drive reactive components 226 remain spaced apart from the drive devices 222. In other words, drive is provided without contact and upon loss of power the drive is decoupled automatically with no mechanical coupling or binding resisting free rolling of the vehicle on the track 210. In other embodiments, the devices 222 may be provided below or to the side of the magnets 226 but still be spaced apart upon loss of power to the devices 222, e.g., the devices 222 do not provide a levitating force for the vehicle 250 relative to track 210 but the vehicle 250 does not have to be suspended from track 210 to practice the invention.

For each vehicle, the ride 200 includes a support or mounting assembly 260 that includes a pair of suspension arms 264 that from an end view appear similar to C-clamps. The magnet array or other ferrous material component 226 of the drive assembly may be supported on a lower portion of the suspension arms 264 and extend between the arms 264 or include spaced apart magnets provided on each arm 264. The vehicle 250 includes a body 252 with seats for passengers and is attached to the support or mounting assembly 260 via hanger or beam member 254 that extends upward from the body 252 to a cross bar between the arms 264. The vehicle 250 is adapted for free rolling when the drive 220 is decoupled, and, to this end, the support assembly 260 includes a number of wheels or rolling elements to attach it to the rails 212, 216.

Specifically, in the illustrated embodiment, a set of three upper rollers or wheels 262 are provided on each arm 264 via axles 263 to abut upper rail 212, with the axles 263 providing a free or non-mechanically coupled rotation point for the wheels 262. The support assembly 260 further includes a set of two lower rollers or wheels 266 on each arm 264 via axles 267 to abut or contact the outer surfaces of lower rail 216. The center one of the upper wheels 262 may be used as a main vertical load bearing member while the other wheels in the upper set 262 and lower set 266 may be used more for controlling side-to-side movement or to provide horizontal stability for the vehicle 250. Again, the track 210 may be configured differently such as with a single tube or the like, and the number and position of the wheel or rolling members 262, 266 may be varied to provide a free rolling support or load bearing connection between the vehicle 250 and the track 210 to allow the vehicle 250 to roll simply under the influence of gravity such as in inclined sections of the track 210.

The particular electromagnet drive technology used to implement the drive assembly 220 may be varied to practice the invention. In one embodiment, the drive assembly 220 provides a magnetic pacer for selectively controlling speeds of the vehicle 250 in the ride 200 as is taught in U.S. Patent Appl. Publ. No. 2009/0114114, which is incorporated herein in its entirety by reference. Briefly, the drive assembly 220 may provide methods and systems for pacing or controlling the speed of the vehicle 250 in the amusement park ride. Particularly, the magnetic pacer assembly 220 and methods of using such an assembly may be used to provide a non-contact or "touch less" mechanism for selectively and accurately applying a thrust to slow or to accelerate the vehicle 250 during operation of the ride 200 to achieve a speed or velocity within an acceptable range. Generally, magnetic forces may be applied in or along a direction of travel ("DOT") such as with magnetic thrusters 222 (e.g., a LSM, a LIM, or the like) to propel the car 250 or opposite the DOT to resist its travel and reduce the momentum of the car 250.

Embodiments of the invention may use a linear synchronous motor (LSM) or other magnetic thruster 222 as part of a magnetic pacer or drive assembly 220 to achieve a desired vehicle velocity and to provide speed corrections in the show or flat portions of the ride, and these speed controls may include determining the initial speed or velocity of the train or vehicles of a ride as it enters the pacer area of the ride (e.g., enters a flat portion of the track or another portion of the track near a show system). Based on this determined speed, resistive or propulsive forces are applied to drive reactive components that may be conductors, magnets, magnet arrays, magnetic force reaction plates, or the like 226 mounted on the vehicles 250 or mounting assemblies 260 with magnetic thrusters (or magnetic propulsion devices) 222 positioned adjacent to or on the track 210 that are controlled and powered to adjust the direction of the magnetic field, the timing of the application of such magnetic forces (attracting or repulsing), and, in some cases, the magnitude of the generated magnetic fields.

The magnetic pacer assemblies or drives 220 provide a touch free and low maintenance system for controlling a vehicle's speed. Portions of these assemblies can be fitted in flat stretches of track and also in flat and compound curves and sloped sections of track, which allows ride designers more freedom in creating interesting tracks and rides with unique mixes of thrill and show. Decoupling is automatic upon loss of power as the magnets or other drive reactive forces 226 associated with the vehicles 250 are positioned in the ride 200 to remain spaced apart from the magnetic drives 222 even upon loss of power to the drive assembly 220 and the magnetic force used to drive or propel the vehicle 250 is removed upon loss of power. Some embodiments may provide a fault mode where an eddy current is used to slow travel of the vehicle 250 to control its speed as it approaches or reaches an evacuation segment of the track 210. Minimal eddy current forces likely will exist and resist vehicle motion by inducing a current in the stators (if present) as the vehicle moves along the track. Upon loss of power, the vehicle 250 will glide due to its own momentum and/or under the influence of gravity to a next (or previous) evacuation segment of the track 210, which is at a lower height or elevation (relative to non-evacuation segments of the track 210).

Figure 4:
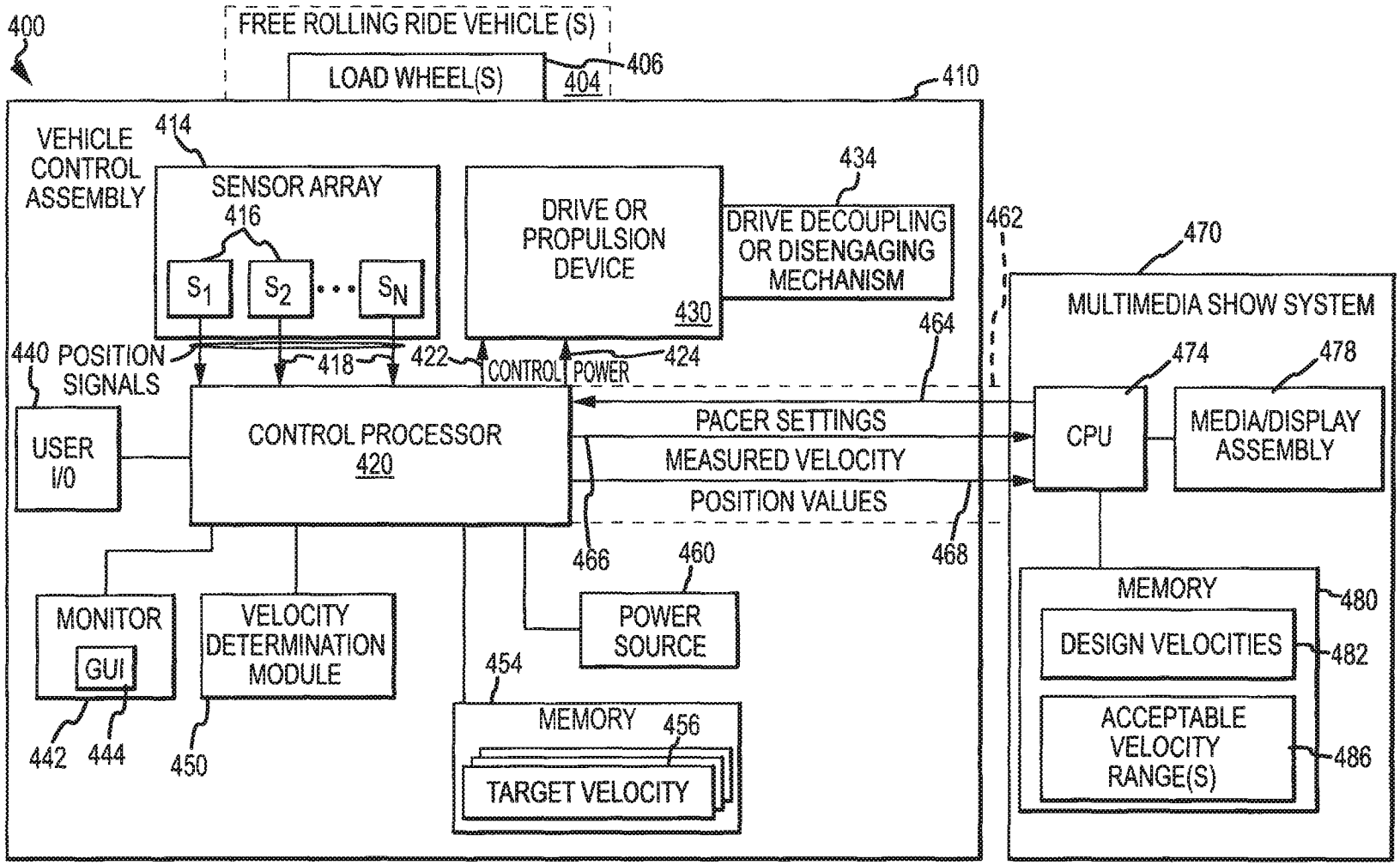
FIG. 4 is a functional block diagram for a portion of an amusement park ride control system that includes a vehicle control assembly with a drive device that provides for selective decoupling/disengaging with free-rolling ride vehicles.

FIG. 4 illustrates an example of an amusement park ride control system 400 in functional block form that includes a vehicle control assembly 410 for pacing or controlling the speed of a ride vehicle or vehicles 404. The vehicles 404 are free-rolling vehicles such as suspended vehicles of a dark ride that are supported on wheels or rolling members 406 that provide contact surfaces for the vehicle 404 with a track (not shown in FIG. 4) and allow contact or decoupled driving with a drive or propulsion device 430 (such as an LSM, LIM, or other drive device). Typically, the vehicle control assembly 410 is used to adjust the speed of the vehicle 404 as it travels over a particular portion of a ride track that is considered a show or story portion in which a multimedia show system 470 is presenting a show or display and to also move the vehicle 404 up steeper inclines that may be followed by free falls or drops of the vehicles 404 using gravity (e.g., decoupled from drive 430).

The multimedia show system 470 may provide a show portion of a ride and include a media/display assembly 478 (e.g., video, audio, animatronics, and the like) that is operated by a processor or controller 474 in a manner that is synchronized with the travel of the ride vehicle 404 through the show portion of the ride track and, in some cases, in a manner that is synchronized with the velocity of the ride vehicle 404. In other words, the media/display assembly 478 may be operated when a vehicle 404 is sensed to be in the show portion, and the media (such as a video or animatronic function) may be timed based on a design, goal, or target velocity for the vehicle 404. This design velocity 482 may be stored in memory 480 of the show system 470 along with an acceptable velocity range 486. These values may be transferred or communicated as pacer settings 464 over a digital communication network or lines 462 to the vehicle control assembly 410.

The vehicle control assembly 410 includes a controller or control processor 420 that functions to process the pacer settings 464 and to store in memory 454 a target or goal velocity 456 for a ride vehicle 404 in particular show portions of the track. The system 400 may include a computer or an electronic system configured for processing sensor signals 418 from sensors 416 of a vehicle position/velocity sensor array 414 and for responding by controlling operation of the vehicle control assembly 410. The assembly 410 further may include a control module as part of or separate from control processor 420 that may be software, firmware, and/or hardware and that controls operation of the assembly 410. The specific computer and electronics hardware and computer software and programming languages implemented to practice the invention is not limiting. Similarly, communications of digital and electronic signals may be performed in any well-known manner such as via the use of serial communication lines or busses, via communications networks such as LAN, WAN, and the like, and in a wired or wireless manner as is known or as may later be developed.

The vehicle control assembly 410 includes a drive or propulsion device 430 that is used to provide a driving or propelling force to the ride vehicle 404 in a manner that may be decoupled or disengaged such as by a mechanism 434 upon loss of power or other system fault that requires evacuation of vehicles 404. In one embodiment, a magnetic array(s) is positioned on the vehicle 404, and the drive 430 is an LSM or LIM magnetic propulsion device(s) that selective applies a magnetic thrust force to move the vehicle 404 in a DOT or non-DOT on the track. In such a case, the decoupling mechanism 434 may be thought of as including the mounting assembly that retains the magnet on the vehicle 404 spaced apart from the propulsion device 430 upon loss of power (e.g., there is no mechanical coupling and the drive 430 is automatically disengaged upon power loss).

Figure 5:
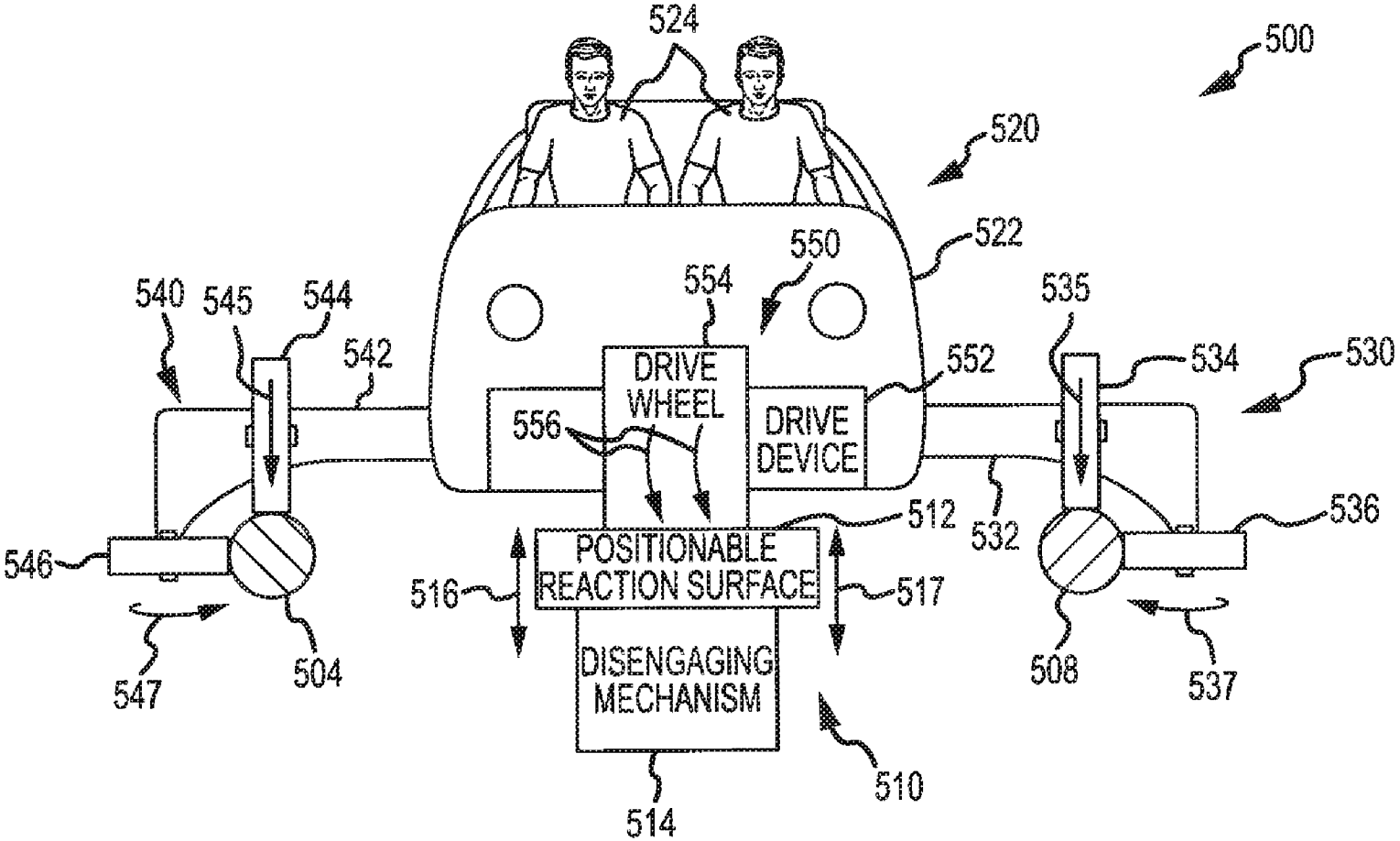
FIG. 5 illustrates an end view of a ride system of an embodiment that uses a positionable drive track or belt to selectively disengage an onboard drive (e.g., a drive wheel) such as in a freefall or steep decline in the track and upon power loss to allow free rolling by support or load bearing wheels or rollers that remain in contact with a track (e.g., the vehicle is track guided in this example).

In other embodiments, the drive or propulsion device 430 may take a number of other forms (e.g., see the embodiment of FIG. 5). For example, propulsion may be provided by a fan, a jet propulsion mechanism, a releasable pinch mechanism, and the like. In such cases, the decoupling mechanism may again be thought of as the mounting structure that retains the drive device 430 spaced apart or without contact/mechanical coupling with the vehicle 404 such that it may freely roll on the track via load wheels 406 contacting the track/rails. In other cases, the decoupling mechanism 434 may include an actuator that operates when power from power source 460 is provided to the propulsion mechanism 430 to position all or a portion of the propulsion mechanism 430 (such as drive wheels) against the vehicle body or frame. A passive device (s) such as a spring or other resilient component may be used to resist the positioning of the propulsion mechanism by the actuator such that upon loss of power from source 460 the spring force being applied by the spring/resilient component of the drive decoupling mechanism 434 acts to push the drive device 430 apart from the vehicle 404 (e.g., to automatically decouple or disengage the drive 430 from the vehicle 404). Numerous other means for decoupling a drive upon loss of power will be evident to those skilled in the art building upon this description and are considered within the breadth of the invention.

A sensor array 414 with two or more sensors 416 may be positioned in the assembly 410 to be proximate to a track (not shown) upon which the vehicle 404 travels and to also be proximate or adjacent to the propulsion device 430. The sensors 416 are linked to the control processor 420 and transmit position signals 418 to the processor 420, which may respond by determining a position of the ride vehicle 404 (e.g., to relay position values 468 to the multimedia show system 470 for use in operating the media/display assembly 478). Further, the processor 420 may run a velocity determination module 450 to determine a velocity of the vehicle 404 from two or more of the position signals 418. For example, the position sensors 416 are used to measure a position of one or magnets in an array on the vehicle 404, and vehicle velocity is derived based on measured position and time (e.g., time for magnet to move between two positions). The control processor 420 then determines whether to operate a propulsion device 430 (such as an LSM or LIM) using control signals 422 and/or by providing power 424 to the device 430 from power source 460 (which may be part of assembly 410 as shown or be a separate device).

The control by processor 420 may include selecting whether the propulsion device 430 is to apply a resistive or braking force (i.e., when the determined velocity is greater than a target velocity 456 or over a trigger point) or to apply a propulsive or accelerating force (i.e., when the determined velocity is less than the target velocity 456 or less than a minimum trigger velocity). In some embodiments, the processor 420 may also run a force/power module to determine a power level 424 to provide to the propulsion device 430 to achieve a braking or propulsive force of a particular magnitude (e.g., a maximum force when the differential between measured and target velocity exceeds a particular value and a smaller force at other differentials).

The pacer assembly 410 may further include a user input and output (I/O) 440 (e.g., a mouse, keyboard, touch screen, and the like) allowing a user or operator of the assembly 410 to input information such as to manually adjust the target velocity 456 or to set trigger points, to set power levels provided by processor 420, and to request particular displays (such as tables of determined velocities for the ride vehicle 404 and graphs showing determined velocities relative to desired values). A monitor 442 is also provided with a display or GUI 444 for showing velocity data, current settings, and the like.

As shown, the multimedia show system 470 operates a media/display assembly 478, and initiation of a display or function may be performed in response to receiving position values 468 from the vehicle control assembly 410 or from a separate position sensor assembly (not shown). In some embodiments, the CPU 474 also receives a measured velocity 466 for the ride vehicle 404 from the control processor 420 of the vehicle control assembly 410. The CPU 474 may present this information to the media/display assembly 478, which, in turn, may operate based on this real time data. For example, controlled speed scenes may have relatively slow velocities (e.g., to reduce the use of track length and the like), and, as a result, the target velocity may be selected from the range of 1 to 6 feet per second or some other useful range. In this example, it may be useful to maintain the target velocity within a fairly small range such as plus or minus 1 to 2 percent of the target velocity. In other cases, the multimedia show system 470 may provide the pacer settings 464 in a more dynamic manner. In these cases, the media/display assembly 478 may provide the pacer settings 464 for use by the control processor 420 of the vehicle control assembly 410 in setting a target velocity 456 and/or trigger points. The media/display assembly 478 then operates to display or create the scene matching the newly provided pacer settings 464 when the next ride vehicle(s) 404 travel by the magnetic pacer assembly 410 (as determined by position values 468 or other techniques), and the assembly 410 paces the vehicle 404 based on these dynamic settings.

FIG. 5 illustrates an end view of another amusement park ride 500 of the invention. As discussed above, the drive mechanism or assembly used to drive a vehicle in a ride may be varied as long as the drive and vehicle become decoupled or disengaged upon loss of power or a fault that requires vehicle evacuation. Magnetic drives are just one example of such a drive assembly. Additionally, the ride 500 shows that the vehicle does not have to be a suspended vehicle to practice the ride techniques taught herein.

As shown, the ride assembly 500 includes a dual rail structure providing the track with left and ride tubes or tubular rails 504, 508. A drive assembly 510 is used to provide the propelling or driving force for the vehicle 520. The vehicle 520 includes a body 522 with seats for passengers 524. The vehicle 520 includes left and right support or mounting assemblies 530, 540 that each include arms or struts 532, 542 extending outward from the sides of the body 522 toward rails 508, 504, respectively. The left strut 532 pivotally or rotatably supports at least a pair of wheels/rollers 534, 536 that contact the rail 508 and freely roll as shown at 535, 537. Likewise, the right strut 542 supports at least a pair of wheels/rollers 544, 546 that roll relatively freely as shown at 545, 547 to allow the vehicle 520 to roll in a track-guided manner along a path defined by the track rails 504, 508. A path is defined in the ride 500 by rails 504, 508 with differing elevations that define non-evacuation and evacuation segments or zones with the non-evacuation segments typically including a minimum incline that prevents the vehicle 520 from remaining in these segments when a driving assembly 510 is disengaged as gravity causes the vehicle 520 to roll to a lower elevation/height evacuation segment or zone.

The drive assembly 510 in the ride 500 is adapted for automated decoupling with the vehicle body 522 upon loss of power. To this end, the drive assembly 510 includes a drive wheel 554 that is positioned within or attached to the body 522 of the vehicle 520 and is selectively driven to rotate 556 by a drive device 552 provided in or on the body 522. The body 522 is caused to move along the rails 504, 508 of the track of ride 500 by selectively raising or positioning 516, 517 a positionable drive platform (or fixed/static drive reaction surface) 512 to be in contact with the drive wheel 554. The drive reaction surface or platform 512 may be selectively positioned against the wheel 554 by operation of a disengaging mechanism 514, which may position 516, 517 the drive reaction surface 512 in contact when power is provided to the disengaging mechanism 514 (and drive device 552).

When power is lost, the disengaging mechanism 514, such as with a spring element or using gravity, may drop or move 516, 517 the drive reaction surface 512 to a fault position apart a gap from the wheel 554. In this manner, the drive assembly 510 is disengaged with loss of power, and the vehicle 520 is able to freely roll on supporting wheels or rolling elements 534, 536, 544, 546 on rails 504, 508, such as to drop under the influence of gravity to an evacuation zone or segment. In some embodiments of the ride 500, the rails 504, 508 may define a track with steep declines or free fall zones/segments, and the disengaging mechanism 514 of drive assembly 510 may be operated to move 516, 517 the positionable belt away from the wheel 554 to provide a free falling or dropping sensation in the ride 500 (or the track may simply include a portion where no drive reaction surface 512 or mechanism 514 is provided such as in a steeply declining section where gravity is used to drive or move the vehicle 520).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the amusement park rides described herein are particularly well suited for a suspended ride system with the vehicles positioned below the track but other rides may benefit from the described ideas. Dark rides that may include suspended ride systems are suited for the described propulsion or drive systems since initial costs are proportional to length of track, complexity of track, and thrust force required, and all of these design parameters may be retained relatively low for typical dark ride system using the concepts taught by this description. More complex rides may also realize lifecycle cost benefits through use of the describe amusement park rides and drive techniques based on reduced consumables/maintenance and increased reliability.

The described amusement park rides that utilize a LSM/LIM-type drive or propulsion system provide a number of advantages. With regard to show benefits, the rides provide true gravity drops with smooth transitions, a silent/quiet propulsion system, continuously variable or controllable vehicle velocity, backward drive, stopping/braking abilities, reprogrammable/customizable motion and speed profiles, multiple motion profiles, good positional accuracy/feedback synchronization with show portions, temporary or continuous platooning or training vehicles together, and potential to get multiple degrees of freedom vehicle motion from propulsion system. With regard to operational benefits, the rides provide predictable vehicle motion under fault conditions, reduce attraction lifecycle costs, energy efficiency, dynamic braking, good speed repeatability supporting higher ride capacity/throughput, reduced maintenance, fewer consumables, high reliability, lighter/cheaper/less complex vehicles, lower force on vehicle or load wheels, and high resolution tracking of vehicle position. Further, thrust/propulsion does not rely on friction or normal force, which allows steeper inclines (even vertical lifts) to be incorporated into track design. During power loss in electromagnetic-based drives, stators may short to provide eddy current braking. Additionally, evacuation procedures for suspended ride systems may be designed via free-rolling vehicles and track elevations to be similar to flume or coaster rides at evacuation zones or segments of the track.

We claim:

1. An amusement park ride, comprising:

a track with at least one rail defining a ride path, wherein the ride path includes at least one evacuation zone along a first length of the track at a first height and a non-evacuation zone along a second length of the track with portions at a second height greater than the first height and wherein the at least one rail of the non-evacuation zone is sloped toward the evacuation zone;

a vehicle supported on the at least one rail with at least one roller element; and a drive assembly providing a driving force, in the non-evacuation zone, for moving the vehicle along the ride path and configured for automatically disengaging from the vehicle upon loss of power to the drive assembly, whereby gravity causes the vehicle to roll on the at least one roller element to the evacuation zone from the non-evacuation zone.

2. The ride of claim 1, wherein the drive assembly comprises an electromagnetic drive member provided proximate to the track for providing the driving force and at least one drive reactive component comprising a ferrous metal positioned on the vehicle to be spaced apart a distance from the electromagnetic drive member when the vehicle is supported on the track by the at least one roller element.

3. The ride of claim 2, wherein the vehicle is suspended below the at least one rail.

4. The ride of claim 3, wherein the electromagnetic drive member is mounted to the at least one rail and the at least one drive reactive component is provided on the vehicle to be vertically below the electromagnetic drive member.

5. The ride of claim 3, wherein the drive reactive component comprises at least one magnet and wherein the electromagnetic drive member comprises at least one linear synchronous motor (LSM) operated by a vehicle control assembly to power and control the at least one LSM to apply the driving force to the at least one magnet to accelerate or to decelerate the vehicle along a present direction of travel for the vehicle on the ride path.

6. The ride of claim 3, wherein the drive reactive component comprises at least one conductor and wherein the electromagnetic drive member comprises at least one linear induction motor (LIM) operated by a vehicle control assembly to power and control at least one LIM stator to apply the driving force to the at least one drive reactive component to accelerate or to decelerate the vehicle along a present direction of travel for the vehicle on the ride path.

7. The ride of claim 1, wherein the non-evacuation zone includes a free fall zone and the drive assembly is operable to disengage at a first point in the free fall zone and to re-engage at a second point in or after the free fall zone.

8. The ride of claim 1, wherein the drive assembly includes means for spacing apart a first portion of the drive assembly provided on the vehicle from a second portion of the drive assembly provided on the track, the first and second portions being in contact when the driving force is being provided by the drive assembly, whereby the vehicle becomes free rolling on the track via the at least one roller element.

9. The ride of claim 1, further including a plurality of additional ones of the evacuation zone and the non-evacuation zone arranged in an alternating pattern and further including additional ones of the drive assembly provided in each of the non evacuation zones to provide a driving force for moving the vehicle along the ride path and for automatically disengaging from the vehicle upon loss of power.

10. A ride with evacuation on power loss, comprising:

a track with an evacuation segment at a height and two or more non-evacuation segments at one or more heights greater than the height of the evacuation segment, the non-evacuation segment being inclined toward the evacuation segments;

a vehicle supported on the track on a set of roller elements; and a drive assembly including a drive reactive component formed of a ferrous metal that is provided on the vehicle to be proximate to the track and a magnetic propulsion device positioned proximate to the track and spaced apart from the drive reactive component, the magnetic propulsion device selectively operable to generate a magnetic field that applies a force upon the drive reactive component to move the vehicle along the track at least in the non-evacuation segments.

11. The ride of claim 10, wherein the magnetic propulsion device comprises a plurality of LSM or LIM devices positioned end-to-end along a length of the track including the evacuation segment and at least a portion of the non-evacuation segment and wherein the drive reactive component comprises at least one magnet or at least one conductor.

12. The ride of claim 11, wherein the track includes a drop zone without the magnetic propulsion device, whereby the vehicle moves through the drop zone based on gravity.

13. The ride of claim 10, wherein the vehicle is suspended from the track on the roller elements.

14. The ride of claim 13, wherein the magnetic propulsion device is provided on the track and the vehicle magnet is positioned below and spaced apart from the magnetic propulsion device.

15. The ride of claim 10, further comprising a controller operating the magnetic propulsion device to control a velocity of the vehicle on the track in the evacuation and non-evacuation segments.

16. An amusement park ride, comprising:

a plurality of vehicles for carrying passengers in bodies including free-rolling wheels;

a track defining a path for the ride and supporting the vehicles via the free-rolling wheels; and a drive assembly individually driving each of the vehicles along the ride path, wherein the drive assembly is operable to drive the vehicles when powered from a power source and to disengage the vehicles upon an event such that the vehicles roll along the track on the free-rolling wheels, wherein the event is a loss of power from the power source or a command signal from a ride control system, and wherein the track includes a plurality of evacuation segments sandwiched between sloped and higher elevation segments, whereby upon loss of power to the drive assembly the vehicles all travel to the evacuation segments.

17. The amusement park ride of claim 16, wherein the drive assembly comprises an electromagnetic drive component generating a magnetic force when powered by the power source and a spaced apart magnet array.

18. The amusement park ride of claim 17, wherein the electromagnetic drive component comprises a plurality of linear synchronous motors (LSMs) arranged in series along the track and wherein each of the LSMs are independently operable to generate a magnetic field that accelerates or decelerates the vehicles by applying the magnetic field to the magnetic array provided on each of the vehicles.

19. The amusement park ride of claim 18, wherein the vehicles are suspended on the track, the LSMs are mounted to the track, and the magnetic array of each of the vehicles is positioned vertically beneath and spaced apart from the LSMs on the track.

20. The amusement park ride of claim 16, wherein the track includes a sloped free fall segment and wherein the drive assembly operates to disengage at an initial point in the free fall segment and to re-engage at a point in the free fall segment further along the path in a direction of travel for the vehicle.

21. The amusement park ride of claim 16, further comprising a vehicle control assembly providing control signals to the drive assembly to independently control a velocity of each of the vehicles based on a position of each of the vehicles on the ride path.

22. An amusement park ride, comprising:

a track with at least one physical element that defines a ride path;

at least one vehicle operable to move along the ride path while being supported relative to the track;

a vehicle drive mechanism producing motive forces between the at least one physical track element and the vehicle in at least two sections of the track defining non-evacuation zones of the ride path such that controlled accelerations or decelerations of the vehicle are produced to move the vehicle along the track in the non-evacuation zones; and means for automatically disengaging the vehicle drive mechanism from the track element upon loss of power such that the motive forces between the at least one physical track element and the vehicle are significantly reduced, wherein the track is configured such that, when the vehicle drive mechanism is disengaged, the vehicle moves to a designated position on the track suitable for evacuation of riders from the vehicle.

23. The ride of claim 22, wherein the track is configured such that when the vehicle drive mechanism is disengaged along a particular portion of the track the vehicle moves relative to the track due to gravitational forces creating a free-rolling show element during operation of the ride.

* * * * *